US008870310B2

(12) United States Patent
Kuba et al.

(10) Patent No.: US 8,870,310 B2
(45) Date of Patent: Oct. 28, 2014

(54) SLIDE RAIL, PAPER FEEDER, AND IMAGE FORMING APPARATUS

(71) Applicants: Yasuhiro Kuba, Kanagawa (JP); Yasutomo Ide, Kanagawa (JP); Tsuyoshi Hashiyada, Tokyo (JP); Toshiki Yokoyama, Kanagawa (JP); Kouhei Okamoto, Kanagawa (JP)

(72) Inventors: Yasuhiro Kuba, Kanagawa (JP); Yasutomo Ide, Kanagawa (JP); Tsuyoshi Hashiyada, Tokyo (JP); Toshiki Yokoyama, Kanagawa (JP); Kouhei Okamoto, Kanagawa (JP)

(73) Assignee: Ricoh Company, Limited, Tokyo (JP)

( * ) Notice: Subject to any disclaimer, the term of this patent is extended or adjusted under 35 U.S.C. 154(b) by 0 days.

(21) Appl. No.: 14/140,868

(22) Filed: Dec. 26, 2013

(65) Prior Publication Data

US 2014/0191645 A1 Jul. 10, 2014

(30) Foreign Application Priority Data

Jan. 7, 2013 (JP) ..... 2013-000340

(51) Int. Cl.
*A47B 88/00* (2006.01)
*A47B 88/04* (2006.01)

(52) U.S. Cl.
CPC ..... *A47B 88/0466* (2013.01)
USPC ..... 312/334.19; 312/334.41

(58) Field of Classification Search
USPC ..... 312/334.9, 334.12, 334.13, 334.15, 312/334.18, 334.19, 334.21, 334.25, 312/334.26, 334.33, 334.37, 334.39, 312/334.43; 384/19, 50, 58–59
See application file for complete search history.

(56) References Cited

U.S. PATENT DOCUMENTS

| | | | | | |
|---|---|---|---|---|---|
| 4,362,346 | A * | 12/1982 | Emmert | 312/311 |
| 5,302,030 | A * | 4/1994 | Buie et al. | 384/18 |
| 5,454,460 | A * | 10/1995 | Lane | 193/37 |
| 5,733,026 | A * | 3/1998 | Munachen | 312/334.12 |
| 5,785,400 | A * | 7/1998 | Grieser et al. | 312/334.12 |
| 6,902,244 | B1 * | 6/2005 | Chen | 312/334.4 |
| 2001/0003407 | A1 * | 6/2001 | Fraccaro | 312/333 |
| 2001/0035704 | A1 * | 11/2001 | Dierbeck | 312/902 |
| 2007/0297703 | A1 * | 12/2007 | Nadeau et al. | 384/58 |
| 2012/0319549 | A1 * | 12/2012 | Hoeft | 312/334.12 |

FOREIGN PATENT DOCUMENTS

| | | |
|---|---|---|
| JP | 04-086441 | 7/1992 |
| JP | 06-070640 | 10/1994 |
| JP | 07-041383 | 9/1995 |
| JP | 2001-173305 | 6/2001 |

* cited by examiner

*Primary Examiner* — Hanh V Tran
(74) *Attorney, Agent, or Firm* — Harness, Dickey & Pierce, P.L.C.

(57) ABSTRACT

A slide rail comprises a fixed rail; a movable rail slidably attached to the fixed rail; and a roller that is attached to at least one of the fixed rail and the movable rail and runs on the other one of the fixed rail and the movable rail as the movable rail slides, the other one of the fixed rail and the movable rail including a running wall on which the roller runs and sliding contact walls that come into sliding contact with opposite side surfaces, in a direction of a rotation axis of the roller, of the roller, wherein the roller includes a metal-made roller main body and a pair of resin-made sliding plates that sandwich the roller main body from opposite sides thereof in the direction of the rotation axis of the roller, and the pair of sliding plates are in sliding contact with the sliding contact walls.

8 Claims, 10 Drawing Sheets

SLIDE RAIL, PAPER FEEDER, AND IMAGE FORMING APPARATUS

CROSS-REFERENCE TO RELATED APPLICATIONS

The present application claims priority to and incorporates by reference the entire contents of Japanese Patent Application No. 2013-000340 filed in Japan on Jan. 7, 2013.

BACKGROUND OF THE INVENTION

1. Field of the Invention

The present invention relates to slide rails used for drawers, cassettes, etc. slidably attached to main bodies of copiers, facsimiles, printers, etc. and also used for cabinets. The invention also relates to a paper feeder and an image forming apparatus.

2. Description of the Related Art

A conventional slide rail of such a type includes a fixed rail, a movable rail, and a retainer with balls that is installed therebetween. The retainer with balls installed in the slide rail includes a plurality of balls and a retainer for rotatably holding the balls. In such a slide rail, when the movable rail slides with respect to the fixed rail, the balls in the retainer with balls roll to allow the movable rail to slide smoothly.

However, the above-described slide rail has a problem with cost because the work for assembling the retainer with balls requires much effort. To solve the above problem, Japanese Laid-open Patent Publication No. 2001-173305, for example, proposes a slide rail with no retailer with balls. As shown in FIG. 17, the conventional slide rail 101 described in Japanese Laid-open Patent Publication No. 2001-173305 includes a fixed rail 110, a movable rail 120, small-diameter roller 130, and large-diameter roller 140.

The movable rail 120 is disposed so as to be slidably fitted to the fixed rail 110. The small-diameter roller 130 is attached to the fixed rail 110, rotates about a rotation axis thereof in connection with sliding of the movable rail 120 to run on the movable rail 120. The large-diameter roller 140 is attached to the movable rail 120, rotates about a rotation axis thereof in connection with sliding of the movable rail 120 to run on the fixed rail 110.

The fixed rail 110 includes a rectangular first substrate 111, a pair of first projecting plates 112 projecting from opposite widthwise ends of the first substrate 111, and first parallel plates 113 parallel to the first substrate 111 and projecting from respective edges of the first projecting plates 112 so as to come close to each other, and these components are integrally formed. The movable rail 120 includes a rectangular second substrate 121, a pair of second projecting plates 122 projecting from opposite widthwise ends of the second substrate 121, and second parallel plates 123 parallel to the second substrate 121 and projecting from respective edges of the second projecting plates 122 so as to come close to each other, and these components are integrally formed.

However, the slide rail 101 using the small-diameter roller 130 and the large-diameter roller 140 shown in FIG. 17 has a problem in that its slidability is lower than that of the conventional slide rail using the retainer with balls. The present inventors have intensively searched for the reason for this and found that the low slidability is caused by the following reason.

In the slide rail 101 using the small-diameter roller 130 (the large-diameter roller 140), the opposite side surfaces, with respect to the direction of rotation axis, of the small-diameter roller 130 (the large-diameter roller 140) are sandwiched between the second substrate 121 (the first substrate 111) and the second parallel plates 123 (the first parallel plates 113). Therefore, the small-diameter roller 130 (the large-diameter roller 140) rotates with its side surfaces being in sliding contact with the second substrate 121 (the first substrate 111) and the second parallel plates 123 (the first parallel plates 113).

The sliding contact of the side surfaces of the small-diameter roller 130 (the large-diameter roller 140) with the second substrate 121 (the first substrate 111) and the second parallel plates 123 (the first parallel plates 113) causes frictional force, and the frictional force impairs slidability. The slide rail 101 shown in FIG. 17 will be described in detail. As shown in FIG. 18, when a supported body 150 is supported by two slide rails 101, a force indicated by arrow A2 acts on the supported body 150 because of its weight. The force indicated by arrow A2 causes falling forces indicated by arrows B2 and C2 acting on the two slide rails 101.

When the falling forces are generated, pressing forces against the upper second parallel plate 123, the upper second projecting plate 122, and the lower end of the second substrate 121, surrounded by respective dotted lines in FIG. 17, respectively are generated in the small-diameter roller 130. In addition, pressing forces against the upper first parallel plate 113, the upper first projecting plate 112, and the lower end of the first substrate 111, surrounded by respective dotted lines in FIG. 17, respectively are generated in the large-diameter roller 140.

As shown in FIG. 19, when the slide rail 101 is pulled in the direction indicated by arrow G3, the small-diameter roller 130 (the large-diameter roller 140) in contact with the upper second projecting plate 122 (the upper first projecting plate 112) rotates in the direction indicated by arrowed line I2. When the small-diameter roller 130 (the large-diameter roller 140) rotates in the direction indicated by arrowed line I2, a kinetic frictional force in the direction indicated by arrowed line J2 acts on the upper second parallel plate 123 (the upper first parallel plate 113), and a kinetic frictional force in the direction K2 acts on the lower end of the second substrate 121 (the first substrate 111). In this case, since the kinetic frictional force in the direction indicated by arrowed line J2 acts in the same direction as the direction indicated by arrow G3, i.e., the pulling direction, the resistance caused by this frictional force is small. However, since the frictional force in the direction indicated by arrowed line K2 acts in a direction opposite to the direction indicated by arrow G3, this frictional force causes large resistance. Therefore, when the frictional forces between the rails and the rollers are large, slidability deteriorates.

To improve the slidability, it is contemplated to use a resin such as polyacetal (POM: polyoxymethylene) or polyamide (PA) for the material of the rollers. Assume, for example, a case in which the rails are formed from a steel plate (SECC) generally used as a sheet metal material. Then a conventional product A in which stainless steel (SUS) was used as the roller material and a conventional product B in which a resin (for example, PA) was used as the roller material were produced, and their sliding forces with respect to the weight of the supported body 150 were measured. The results are shown in FIG. 20.

As shown in FIG. 20, when the rollers are formed from the resin, the sliding force can be reduced. However, since the allowable stress of the resin (for example, POM) is about 50 MPa, which is 1/10 of the allowable stress of the SUS (about 520 MPa), the conventional product B cannot support a high load.

When a resin increased in strength by adding glass fibers (GF) thereto (for example, PA+GF45) is used for the material of the rollers, the rollers can support a certain load or higher in high-load applications. However, with the material containing the GF added thereto, the GF appearing on the surface of the rollers scrapes the rails when the rollers slide on the rail, and the rollers and the rails wear each other. Therefore, this material is not suitable for applications that require high durability.

For example, when a metal (for example, SUS) is used as the material of the rollers, the rollers can support a high load and have high durability. However, the frictional force between the rails and the rollers becomes high, so that slidability deteriorates as shown in FIG. 20. By changing the material of the rails to SUS or by plating the SECC with Ni, surface roughness can be improved. However, with such a method, the rails are much more costly than those formed of SECC alone, so that the rails cannot be produced at low cost.

As described above, the conventional slide rails have a problem in that high-load resistance and high durability cannot be achieved simultaneously with high slidability.

In view of the above circumstances, there is need to provide a slide rail having high-load resistance and high durability and simultaneously having high slidability.

SUMMARY OF THE INVENTION

It is an object of the present invention to at least partially solve the problems in the conventional technology.

According to the present invention, there is provided a slide rail comprising: a fixed rail; a movable rail configured to be slidably attached to the fixed rail; and a roller configured to be attached to at least one of the fixed rail and the movable rail and runs on the other one of the fixed rail and the movable rail as the movable rail slides, the other one of the fixed rail and the movable rail including a running wall on which the roller runs and sliding contact walls that come into sliding contact with opposite side surfaces, in a direction of a rotation axis of the roller, of the roller, wherein the roller includes a metal-made roller main body and a pair of resin-made sliding plates that sandwich the roller main body from opposite sides thereof in the direction of the rotation axis of the roller, and the pair of sliding plates are in sliding contact with the sliding contact walls.

The present invention also provides a paper feeder comprising: a pull-out paper feeding tray configured to accommodate paper sheets to be fed; and a pair of the slide rails configured to be attached to left and right sides of the paper feeding tray in order to guide the paper feeding tray in a pulling direction, wherein, each of the pair of the slide rails comprises; a fixed rail, a movable rail configured to be slidably attached to the fixed rail, and a roller configured to be attached to at least one of the fixed rail and the movable rail and runs on the other one of the fixed rail and the movable rail as the movable rail slides, the other one of the fixed rail and the movable rail including a running wall on which the roller runs and sliding contact walls that come into sliding contact with opposite side surfaces, in a direction of a rotation axis of the roller, of the roller, wherein the roller includes a metal-made roller main body and a pair of resin-made sliding plates that sandwich the roller main body from opposite sides thereof in the direction of the rotation axis of the roller, and the pair of sliding plates are in sliding contact with the sliding contact walls.

The present invention also provides an image forming apparatus including a slide rail, wherein the slide rail comprises; a fixed rail, a movable rail configured to be slidably attached to the fixed rail, and a roller configured to be attached to at least one of the fixed rail and the movable rail and runs on the other one of the fixed rail and the movable rail as the movable rail slides, the other one of the fixed rail and the movable rail including a running wall on which the roller runs and sliding contact walls that come into sliding contact with opposite side surfaces, in a direction of a rotation axis of the roller, of the roller, wherein the roller includes a metal-made roller main body and a pair of resin-made sliding plates that sandwich the roller main body from opposite sides thereof in the direction of the rotation axis of the roller, and the pair of sliding plates are in sliding contact with the sliding contact walls.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Figure 1:
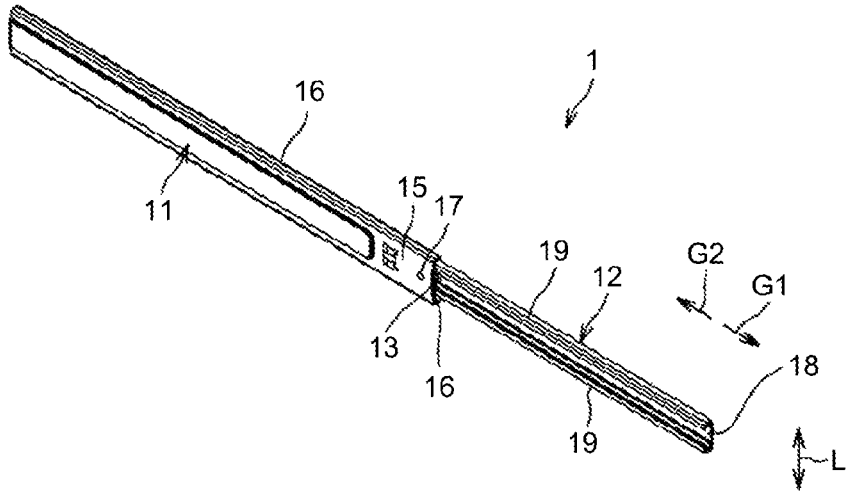
FIG. 1 is a left perspective view illustrating one embodiment of the slide rail of the present invention.

A first embodiment of the present invention will be described with reference to FIGS. 1 to 6. A slide rail 1 shown in FIG. 1 is installed in an image forming apparatus including a device main body (not shown) and a paper feeder 2 (FIG. 6) drawably contained in the device main body. The paper feeder 2 is configured to include a pull-out paper feeding tray 4 for accommodating sheets 3 to be fed and a pair of slide rails 1 attached to the left and right sides of the paper feeding tray 4 in order to guide the paper feeding tray 4 in a pulling direction, as shown in FIG. 6.

Figure 2:
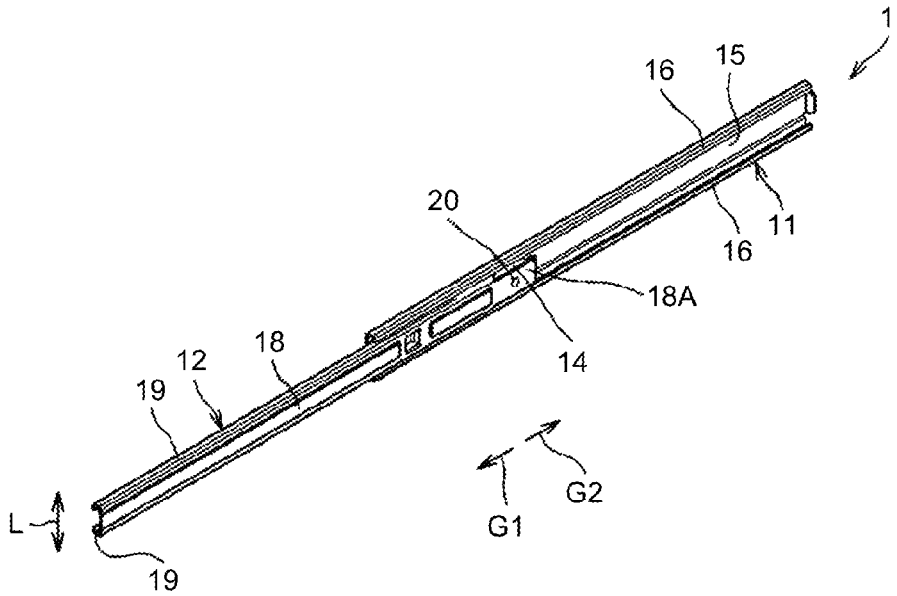
FIG. 2 is a right perspective view of the slide rail shown in FIG. 1.
Figure 3:
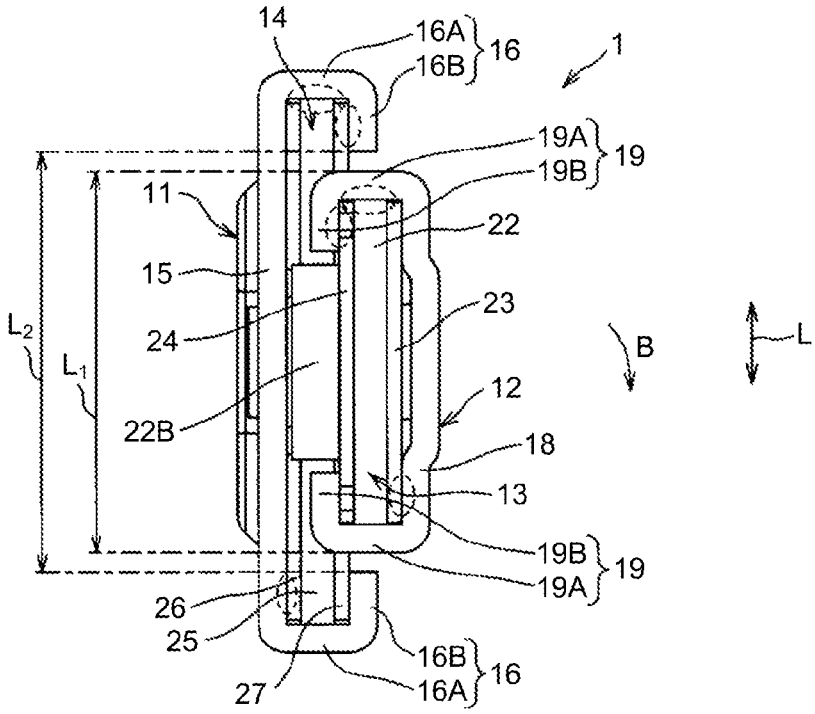
FIG. 3 is a front view of the slide rail shown in FIG. 1.

As shown in FIGS. 1 to 3, each of the pair of slide rails 1 includes a fixed rail 11, a movable rail 12, and a small-diameter roller 13 and a large-diameter roller 14 as the rollers. The movable rail 12 is disposed so as to be slidable with respect to the fixed rail 11 in opposite directions along its length, i.e., a direction indicated by arrowed line G1 of pulling out the movable rail 12 (hereinafter referred to as the pull out direction G1) and a direction indicated by arrowed line G2 of accommodating the movable rail 12 (hereinafter referred to as the accommodation direction G2). The small-diameter roller 13 is attached to the fixed rail 11 and runs on the movable rail 12 as the movable rail 12 slides. The large-diameter roller 14 is attached to the movable rail 12 and runs on the fixed rail 11 as the movable rail 12 slides.

The fixed rail 11 is formed of a metal such as SECC and includes a rectangular first substrate 15 and a pair of first bent sections 16 formed by bending opposite ends, in a widthwise direction L, of the first substrate 15 in a direction in which the opposite ends come close to each other. The first substrate 15 and the first bent sections 16 are formed integrally by subjecting a sheet metal to punching and bending.

A first attachment hole 17 (FIG. 1) for attaching the small-diameter roller 13 described later is provided at the leading end, in the pull out direction G1, of the first substrate 15 so as to pierce the first substrate 15. Each of the first bent sections 16 is formed to have an L-shaped cross section as shown in FIG. 3. More specifically, each first bent section 16 includes: a first projecting plate 16A bent in a direction perpendicular to the first substrate 15; and a first parallel plate 16B bent in a direction perpendicular to the first projecting plate 16A so as to be parallel to the first substrate 15. The pair of first bent sections 16 are disposed over the entire longitudinal length of the first substrate 15.

Similarly to the fixed rail 11, the movable rail 12 is formed of a metal such as SECC and includes a rectangular second substrate 18 and a pair of second bent sections 19 formed by bending opposite ends, in the widthwise direction L, of the second substrate 18 in a direction in which the opposite ends come close to each other. The second substrate 18 and the second bent sections 19 are formed integrally by subjecting a sheet metal to punching and bending.

Each of the second bent sections 19 is formed to have an L-shaped cross section as shown in FIG. 3. More specifically, each second bent section 19 includes: a second projecting plate 19A bent in a direction perpendicular to the second substrate 18; and a second parallel plate 19B bent in a direction perpendicular to the second projecting plate 19A so as to be parallel to the second substrate 18. The second substrate 18 is formed such that its longitudinal length is larger than that of the second bent sections 19. Therefore, the second substrate 18 has, at its leading end in the accommodation direction G2, a section in which no second bent sections 19 are provided (this section may be hereinafter referred to as an extending section 18A), as shown in FIG. 2. A second attachment hole 20 (FIG. 2) for attaching the large-diameter roller 14 described later is provided substantially at the center of the extending section 18A so as to pierce the second substrate 18.

As shown in FIG. 3, the distance $L_1$ between the outer faces of the pair of second projecting plates 19A is set to be shorter than the distance $L_2$ between the ends of the pair of first parallel plates 16B. Therefore, the movable rail 12 can be mounted to the fixed rail 11 so as to be inserted between the first parallel plates 16B of the fixed rail 11. In this case, the fixed rail 11 and the movable rail 12 are mounted to each other such that the first projecting plates 16A project toward the movable rail 12 and the second projecting plates 19A project toward the fixed rail 11.

Figure 4:
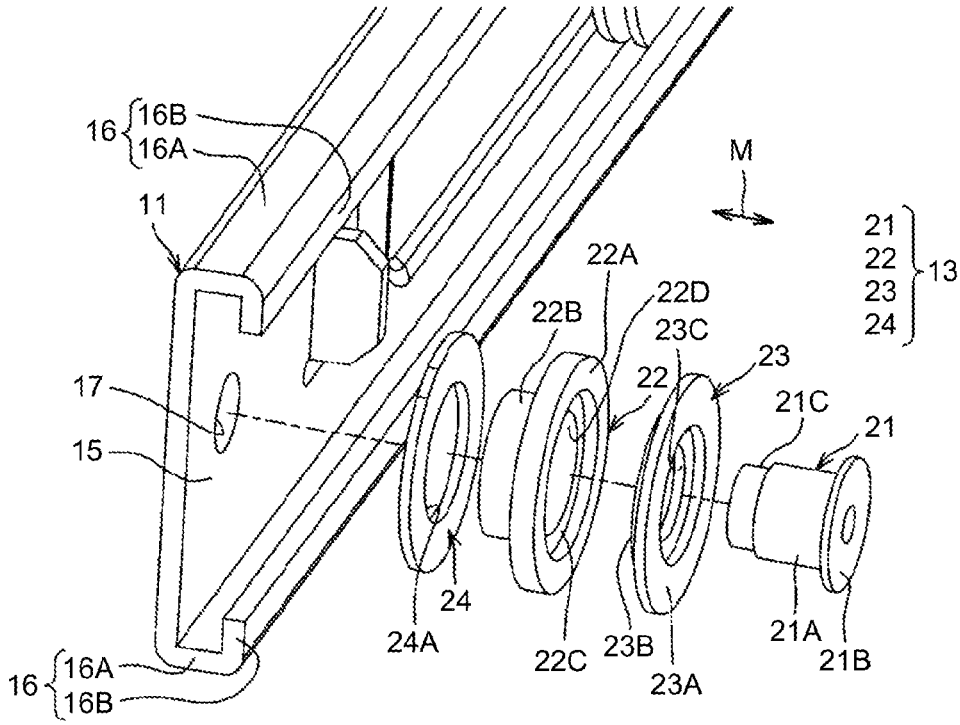
FIG. 4 is an exploded perspective view of a small-diameter roller in the first embodiment.
Figure 5:
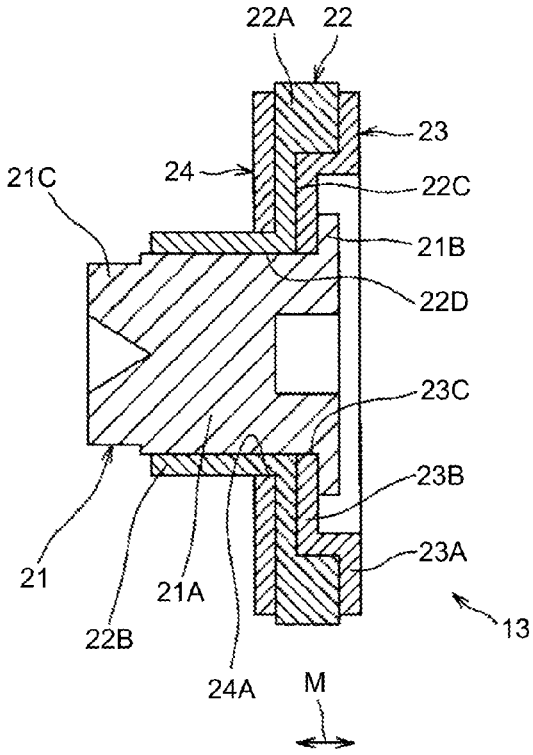
FIG. 5 is a cross-sectional view of the small-diameter roller shown in FIG. 4.
Figure 6:
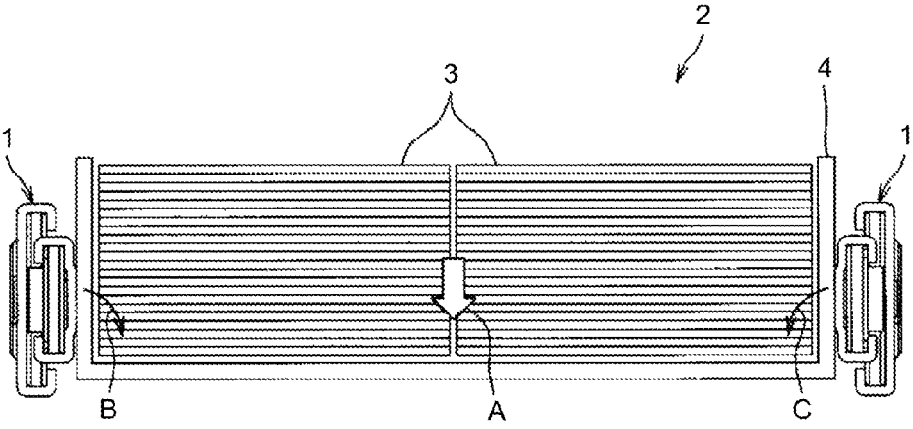
FIG. 6 is a front view illustrating a paper feeder in which the slide rails shown in FIGS. 1 to 3 are installed.

As shown in FIGS. 4 and 5, the small-diameter roller 13 includes a small-diameter rotating shaft 21, a small-diameter roller main body 22 serving as a metal-made roller main body, and a pair of small-diameter sliding plates 23 and 24 serving as resin-made sliding plates that sandwich the small-diameter roller main body 22 from its opposite sides in the direction M of the rotation axis of the small-diameter roller 13. The small-diameter rotating shaft 21 includes a cylindrical shaft main body 21A, a disk-shaped flange section 21B provided at one end of the shaft main body 21A, and a press-fitting section 21C provided at the other end of the shaft main body 21A and having a diameter smaller than that of the shaft main body 21A. By press-fitting the press-fitting section 21C into the first attachment hole 17 formed in the fixed rail 11, the other end of the small-diameter rotating shaft 21 can be secured to the fixed rail 11.

The small-diameter roller main body 22 is formed of a metal such as SUS and includes a disk-shaped disk section 22A and a tube-shaped tubular section 22B for allowing the shaft main body 21A to be inserted thereinto, and these components are formed integrally. A circular recessed section 22C recessed toward the tubular section 22B described later is formed in the disk section 22A. A seat section 23B of the small-diameter sliding plate 23 described later is fitted into the recessed section 22C. A rotation shaft hole 22D for allowing the shaft main body 21A of the small-diameter rotating shaft 21 to be inserted thereinto is provided on the bottom of the recessed section 22C.

The diameter of the rotation shaft hole 22D is smaller than that of the recessed section 22C and is substantially the same as that of the shaft main body 21A. The tubular section 22B projects from the edge of the rotation shaft hole 22D. The tubular section 22B is inserted into a rotation shaft hole 24A of the small-diameter sliding plate 24 described later and protrudes from the small-diameter sliding plate 24 toward the fixed rail 11.

The small-diameter sliding plate 23 is formed of a thermoplastic resin such as PA or POM and is located at a position more distant from the fixed rail 11 than the small-diameter roller main body 22. The small-diameter sliding plate 23 includes a disk-shaped disk section 23A and the seat section 23B formed by recessing the central portion of the disk section 23A into a circular shape, and these components are formed integrally. The disk section 23A is formed to have a diameter slightly smaller than that of the disk section 22A of the small-diameter roller main body 22 and is stacked on the surface of the disk section 22A that is on the side distant from the fixed rail 11. The flange section 21B of the small-diameter rotating shaft 21 is accommodated in the seat section 23B. A rotation shaft hole 23C for allowing the shaft main body 21A of the small-diameter rotating shaft 21 to be inserted thereinto is provided on the bottom of the seat section 23B.

The small-diameter sliding plate 24 is formed of a thermoplastic resin such as PA or POM and is located at a position closer to the fixed rail 11 than the small-diameter roller main body 22. The small-diameter sliding plate 24 is formed into a disk shape having a diameter slightly smaller than that of the disk section 22A of the small-diameter roller main body 22 and is stacked on the surface of the disk section 22A that faces the fixed rail 11. The rotation shaft hole 24A for allowing the tubular section 22B of the small-diameter roller main body 22 and the shaft main body 21A of the small-diameter rotating shaft 21 to be inserted thereinto is formed in the small-diameter sliding plate 24. The small-diameter rotating shaft 21 passes through the rotation shaft holes 22D, 23C, and 24A of the small-diameter roller main body 22 and the pair of small-diameter sliding plates 23 and 24 that are stacked on each other and is then secured to the fixed rail 11. Therefore, the small-diameter roller main body 22 and the pair of small-diameter sliding plates 23 and 24 are attached to the fixed rail 11 so as to be rotatable about the small-diameter rotating shaft 21.

As shown in FIG. 3, the small-diameter roller 13 is attached so as to be sandwiched in the radial direction between the pair of second projecting plates 19A and to be sandwiched in the direction M of the rotation axis between the second substrate 18 and the second parallel plates 19B and is rollable with respect to the movable rail 12. Therefore, when the movable rail 12 slides, the small-diameter roller 13 runs on the second projecting plates 19A of the movable rail 12 while the opposite side surfaces, in the direction M of the rotation axis, of the small-diameter roller 13 are in sliding contact with the second parallel plates 19B and the second substrate 18. Specifically, the second parallel plates 19B and the second substrate 18 correspond to sliding contact walls in claims, and the second projecting plates 19A correspond to running walls. The tubular section 22B of the small-diameter roller main body 22 protrudes from the pair of second parallel plates 19B. However, the tubular section 22B is disposed so as not to come into sliding contact with the first substrate 15.

As shown in FIG. 3, the large-diameter roller 14 includes a large diameter rotation shaft (not shown), a large-diameter roller main body 25 serving as a metal-made roller main body, and large-diameter sliding plates 26 and 27 serving as a pair of resin-made sliding plates that sandwich the large-diameter roller main body 25 from its opposite sides in the direction M of the rotation axis of the large-diameter roller 14. The unillustrated large diameter rotation shaft has the same configuration as that of the above-described small-diameter rotating shaft 21 constituting the small-diameter roller 13 although their dimensions are different, and thus detailed description therefor will be omitted. The unillustrated large diameter rotation shaft can be secured at its one end to the movable rail 12 by press-fitting a press-fitting section (not shown) of the large diameter rotation shaft into the second attachment hole 20 formed in the movable rail 12.

In addition, the large-diameter roller main body 25 and the pair of large-diameter sliding plates 26 and 27 have the same configurations as those of the above-described small-diameter roller main body 22 and the pair of small-diameter sliding plates 23 and 24 constituting the small-diameter roller 13 although their dimensions are different, and thus detailed description therefor will be omitted. The large diameter rotation shaft passes through the rotation shaft holes (not shown) of the large-diameter roller main body 25 and the pair of large-diameter sliding plates 26 and 27 that are stacked on each other and is then secured to the movable rail 12. Therefore, the large-diameter roller main body 25 and the pair of large-diameter sliding plates 26 and 27 are attached to the movable rail 12 so as to be rotatable about their rotation axis.

As shown in FIG. 3, the large-diameter roller 14 is attached so as to be sandwiched in the radial direction between the pair of first projecting plates 16A and to be sandwiched in the direction M of the rotation axis between the first substrate 15 and the first parallel plates 16B and is rollable with respect to the fixed rail 11. Therefore, when the movable rail 12 slides, the large-diameter roller 14 runs on the first projecting plates 16A of the movable rail 12 while the opposite side surfaces, in the direction M of the rotation axis, of the large-diameter roller 14 are in sliding contact with the first parallel plates 16B and the first substrate 15. Specifically, the first parallel plates 16B and the first substrate 15 correspond to the sliding contact walls in the claims, and the first projecting plates 16A correspond to the running walls.

The operation and effect of the slide rail 1 having the above-described configuration will next be described. As shown in FIG. 6, when the paper feeding tray 4 for accommodating sheets 3 is supported by two slide rails 1, a force indicated by arrow A acts on the paper feeding tray 4 because of its weight. The force indicated by arrow A causes two falling forces indicated by arrowed lines B and C and acting on the two slide rails 1.

Figure 7:
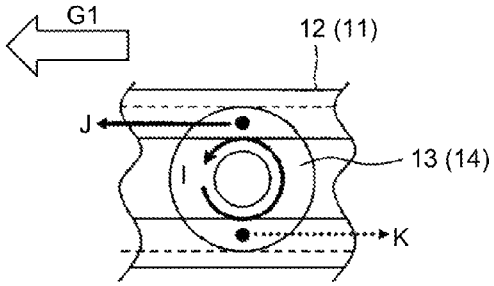
FIG. 7 is a diagram illustrating forces acting on a fixed rail, a movable rail, the small-diameter roller, and a large-diameter roller constituting the slide rail shown in FIGS. 1 to 3.

When the falling forces are generated, pressing forces against the upper second parallel plate 19B, the upper second projecting plate 19A, and the lower end of the second substrate 18, surrounded by respective dotted lines shown in FIG. 3, respectively are generated in the small-diameter roller 13. In addition, pressing forces against the upper first parallel plate 16B, the upper first projecting plate 16A, and the lower end of the first substrate 15, surrounded by respective dotted lines shown in FIG. 3, respectively are generated in the large-diameter roller 14. When the movable rail 12 in this state slides in the pull out direction G1, the small-diameter roller 13 in contact with the second projecting plates 19A rotates in a direction indicated by arrowed line I (hereinafter referred to as the direction I) while being in sliding contact with the second parallel plates 19B and the second substrate 18, as shown in FIG. 7.

In this case, the metal-made small-diameter roller main body 22 runs on the second projecting plates 19A. (Since the disk section 23A of the small-diameter sliding plate 23 and the small-diameter sliding plate 24 have respective diameters slightly smaller than that of the disk section 22A of the small-diameter roller main body 22, they do not come into contact with the second projecting plates 19A.) Similarly, the large-diameter roller 14 in contact with the first projecting plates 16A rotates in the direction I while being in sliding contact with the first parallel plates 16B and the first substrate 15.

Kinetic friction in a direction indicated by arrowed line J (hereinafter referred to as the direction J) occurs on the small-diameter roller 13 because of sliding contact with the second parallel plates 19B, and kinetic friction in the direction K occurs on the small-diameter roller 13 because of sliding contact with the second substrate 18. In addition, kinetic friction in the direction J occurs on the large-diameter roller 14 because of sliding contact with the first parallel plates 16B, and kinetic friction in a direction indicated by arrowed line K (hereinafter referred to as the direction K) occurs on the large-diameter roller 14 because of sliding contact with the second substrate 18. In this case, the kinetic friction in the direction J and the kinetic friction in the direction K serve as resistance to pulling out.

In this embodiment, the metal-made small-diameter and large-diameter roller main bodies 22 and 25 are not in sliding contact with the fixed rail 11 and the movable rail 12, but the resin-made small-diameter and large-diameter sliding plates 23, 24, 26, and 27 sandwiching the small-diameter and large-diameter roller main bodies 22 and 25 come into sliding contact with the fixed rail 11 and the movable rail 12. Since the resin constituting these small-diameter and large-diameter sliding plates 23, 24, 26, and 27 has a lubricating function to some extent, the kinetic frictional forces in the directions J and K decrease when compared with the case where the metal-made small-diameter and large-diameter roller main bodies 22 and 25 come into sliding contact with the fixed rail 11 and the movable rail 12. Therefore, slidability in the pull out direction G1 is improved, and the pulling force is reduced.

The metal-made small-diameter and large-diameter roller main bodies 22 and 25 are disposed between the pairs of resin-made small-diameter and large-diameter sliding plates 23, 24, 26, and 27, respectively. Since the metal-made small-diameter and large-diameter roller main bodies 22 and 25 receive the weight of the paper feeding tray 4, load resistance and durability can be ensured. Therefore, high-load resistance and high durability can be achieved simultaneously with high slidability.

Figure 8:
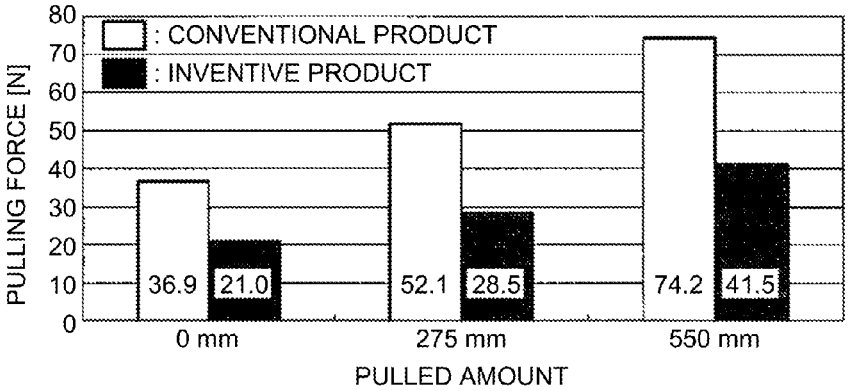
FIG. 8 is a graph showing the results of measurement of pulling force versus the pulled amount of a paper feeding tray 4 for the slide rail shown in the first embodiment (the inventive product) and for a conventional slide rail (conventional product).
Figure 17:
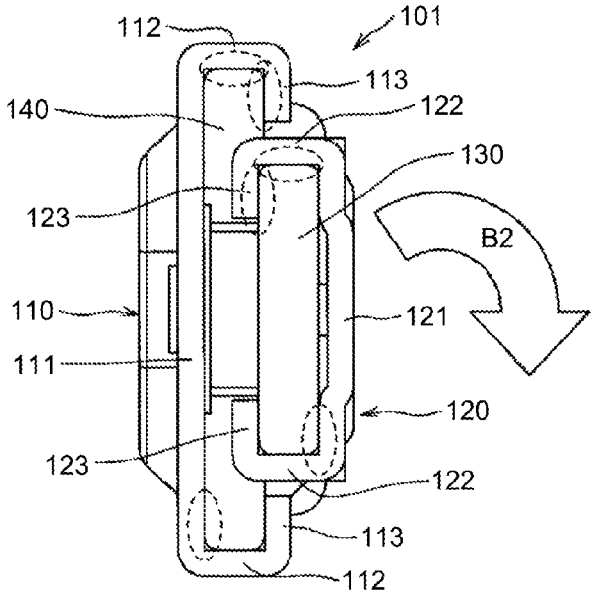
FIG. 17 is a front view illustrating an exemplary conventional slide rail.
Figure 18:
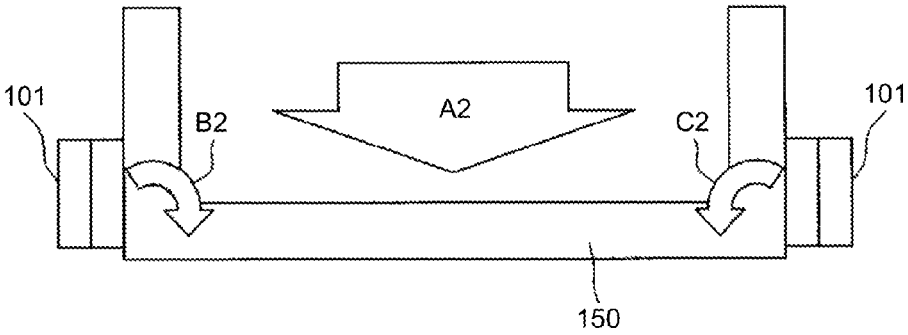
FIG. 18 is a front view illustrating a pair of slide rails shown in FIG. 17 with a supported body being supported.
Figure 19:
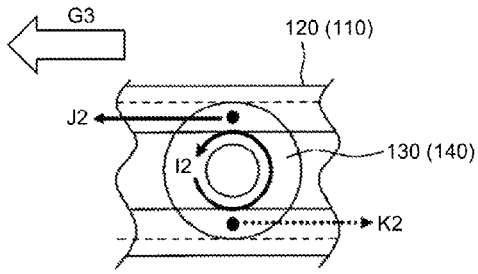
FIG. 19 is a diagram illustrating forces acting on a fixed rail, a movable rail, a small-diameter roller, and a large-diameter roller constituting the slide rail shown in FIG. 17.
Figure 20:
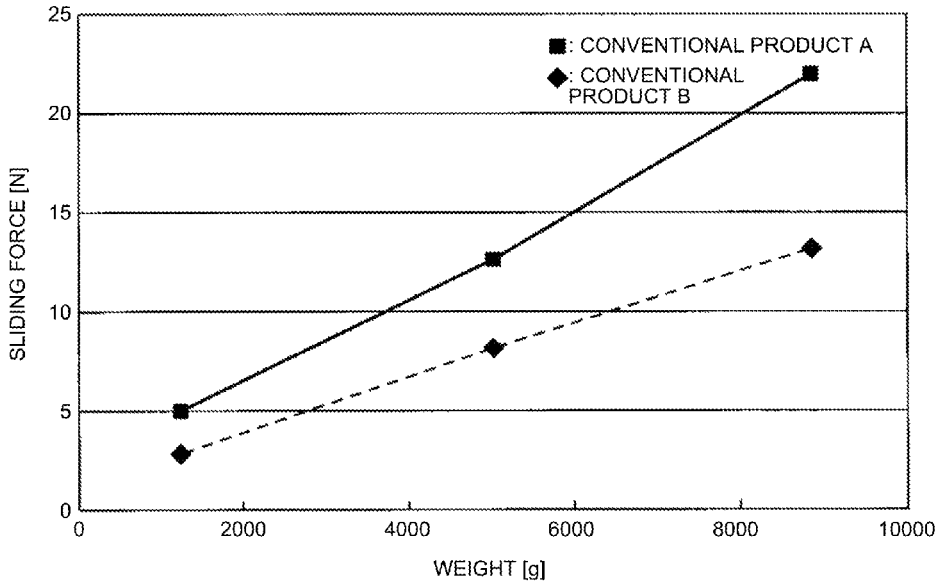
FIG. 20 is a graph showing the results of measurement of sliding force versus the weight of a supported body for a conventional product A produced using SUS as the material of the rollers of the slide rail shown in FIG. 17 and a conventional product B produced using a PA resin as the material of the rollers.

The present inventors measured the pulling force versus the pulled amount of the paper feeding tray 4 using the slide rails 1 (the inventive product) shown in the above first embodiment and the conventional slide rails 101 (the conventional product) shown in FIG. 17 to confirm the effects of this embodiment. The results are shown in FIG. 8. In this case, the pulled amounts were 0 mm, 275 mm, and 550 mm, the weight of the paper feeding tray 4 was 30 kg, and the distances between the pair of slide rails 1 or 101 were 440 mm. The inventive product and the conventional product are the same except that the configurations of the small-diameter and large-diameter rollers 13 and 14 are different.

As can be seen from FIG. 8, the pulling forces when the pulled amounts were 0 mm, 275 mm, and 550 mm were 36.9 N, 52.1 N, and 74.2 N for the conventional product but were reduced to 21 N, 28.5 N, and 41.5 N for the inventive product.

In the above-described embodiment, the metal-made small-diameter main body 22 has the tubular section 22B and large-diameter roller main body 25 also has tubular section (not illustrated), and the tubular sections pass through the small-diameter and large-diameter sliding plates 24 and 27, so that the strength in the direction M of the rotation axis is also improved.

Figure 9:
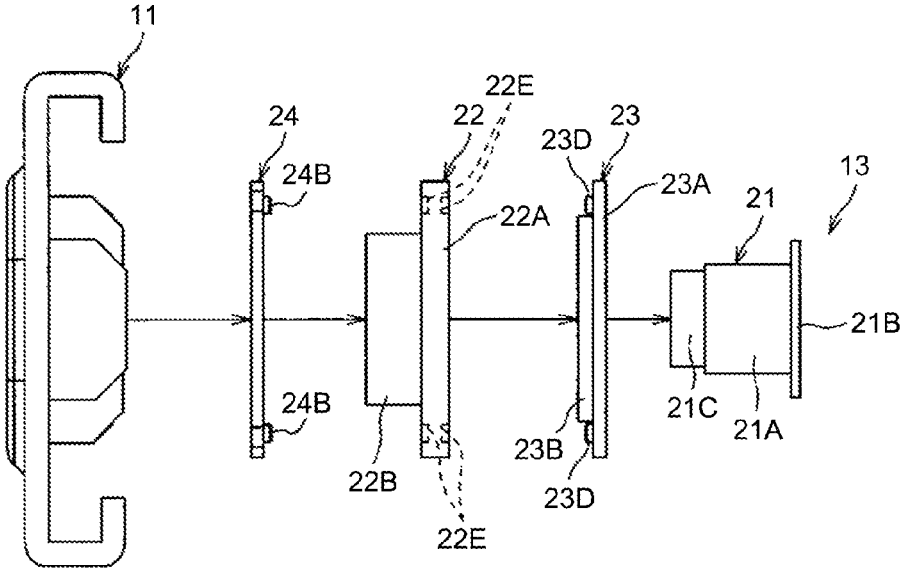
FIG. 9 is an exploded side view of a small-diameter roller in a second embodiment.

Next, a second embodiment of the present invention will be described with reference to FIG. 9. The same parts as those in the above-described first embodiment are denoted by the same reference numerals, and the detailed description thereof will be omitted. The differences from the first embodiment are the configurations of the small-diameter and large-diameter rollers 13 and 14. As shown in FIG. 9, the small-diameter roller 13 includes a small-diameter rotating shaft 21, a small-diameter roller main body 22, and a pair of small-diameter sliding plates 23 and 24, as in the first embodiment described above. In the second embodiment, press-fitting recesses 22E for securing the small-diameter sliding plates 23 and 24 are provided in the disk section 22A of the small-diameter roller main body 22.

A protrusion 23D protruding toward the small-diameter roller main body 22 and press-fitted into the press-fitting recess 22E is provided in the disk section 23A of the small-diameter sliding plate 23. Similarly, a protrusion 24B protruding toward the small-diameter roller main body 22 and press-fitted into the press-fitting recess 22E is provided in the small-diameter sliding plate 24. The small-diameter sliding plate 24 is stacked on the small-diameter roller main body 22 such that the protrusion 24B is press-fitted into the press-fitting recess 22E. The pair of small-diameter sliding plates 23 and 24 are thereby secured to the small-diameter roller main body 22. The large-diameter roller 14 is configured in the same manner as that for the small-diameter roller 13.

In the second embodiment described above, the pairs of small-diameter and large-diameter sliding plates 23, 24, 26, and 27 are secured to the small-diameter and large-diameter roller main bodies 22 and 25, respectively. Therefore, the small-diameter roller 13 and the large-diameter roller 14 can be easily mounted on the movable rail 12 and the fixed rail 11, respectively, because the small-diameter and large-diameter roller main bodies 22 and 25 are integrated with the pairs of small-diameter and large-diameter sliding plates 23, 24, 26, and 27, respectively.

In the second embodiment described above, the pairs of small-diameter and large-diameter sliding plates 23, 24, 26, and 27 are secured to the small-diameter and large-diameter roller main bodies 22 and 25, respectively, by press-fitting, but the present invention is not limited thereto. For example, the pairs of sliding plates 23, 24, 26, and 27 may be secured to the small-diameter and large-diameter roller main bodies 22 and 25, respectively, using another known means, for example, using an adhesive or screws. Only one of the pairs of small-diameter and large-diameter sliding plates 23, 24, 26, and 27 may be secured to the small-diameter or large-diameter roller main body 22 or 25.

Figure 10:
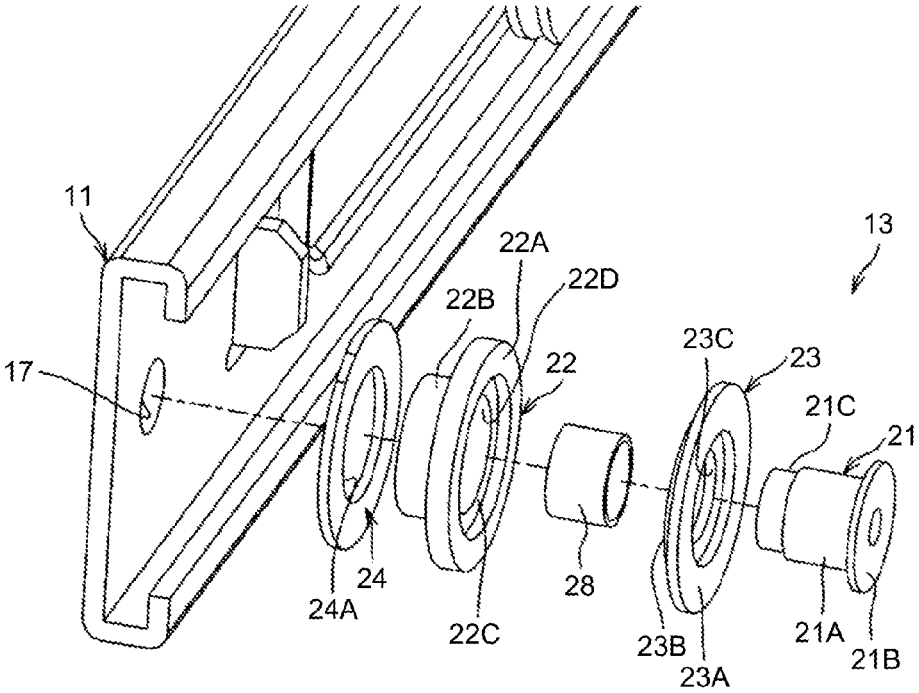
FIG. 10 is an exploded perspective view of a small-diameter roller in a third embodiment.
Figure 11:
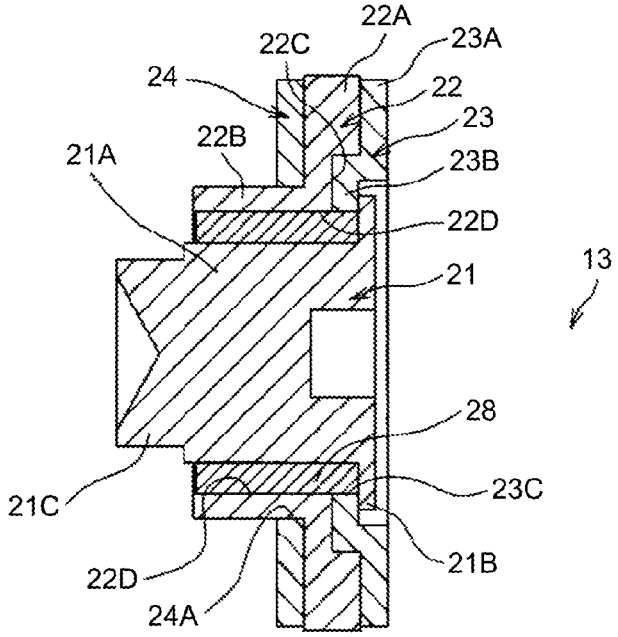
FIG. 11 is a cross-sectional view of the small-diameter roller shown in FIG. 10.

Next, a third embodiment of the present invention will be described with reference to FIGS. 10 and 11. The same parts as those in the above-described first embodiment are denoted by the same reference numerals, and the detailed description thereof will be omitted. The differences from the first embodiment are the configurations of the small-diameter and large-diameter rollers 13 and 14. As shown in FIGS. 10 and 11, the small-diameter roller 13 includes a small-diameter rotating shaft 21, a small-diameter roller main body 22, and a pair of small-diameter sliding plates 23 and 24, as in the first embodiment described above, and further includes a collar 28. The collar 28 is formed into a tubular shape and made of, for example, at least one resin selected from polyacetal (POM), polyamide (PA), polybutylene terephthalate (PBT), polypropylene (PP), polyethylene (PE), an acrylonitrile-butadiene-styrene copolymer (ABS), polystyrene (PS), polyphenylene ether (PPE), polycarbonate (PC), polymethyl methacrylate (PMMA), and fluorocarbon resins.

This collar 28 is inserted into the rotation shaft hole 22D of the small-diameter roller main body 22 (i.e., into the tubular section 22B), and the shaft main body 21A of the small-diameter rotating shaft 21 is inserted into the collar 28. Similarly, the large-diameter roller 14 includes a collar (not shown), as does the small-diameter roller 13 described above.

In the third embodiment described above, when the metal-made small-diameter roller main body 22 rotates, this roller main body 22 does not come into sliding contact with the shaft main body 21A of the small-diameter rotating shaft 21 but rotates through the resin-made collar 28 having a lubricating function. Therefore, slidability is improved, and no lubricating grease is necessary. Similarly, when the metal-made large-diameter roller main body 25 rotates, this roller main body 25 does not come into sliding contact with the shaft main body of the large diameter rotation shaft but rotates through the resin-made collar (not shown) having a lubricating function. Therefore, slidability is improved, and no lubricating grease is necessary.

Figure 12:
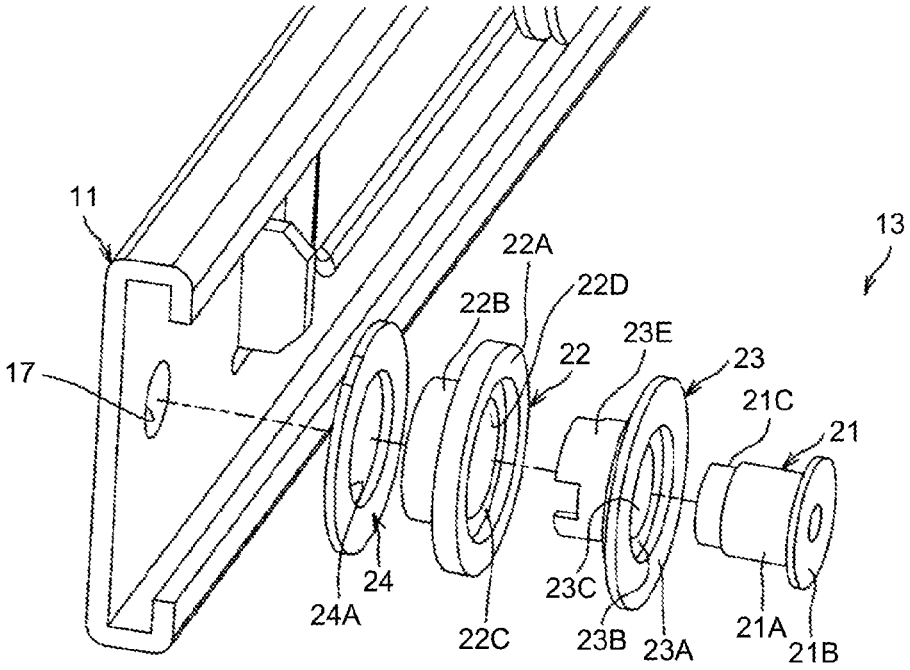
FIG. 12 is an exploded perspective view of a small-diameter roller in a fourth embodiment.
Figure 13:
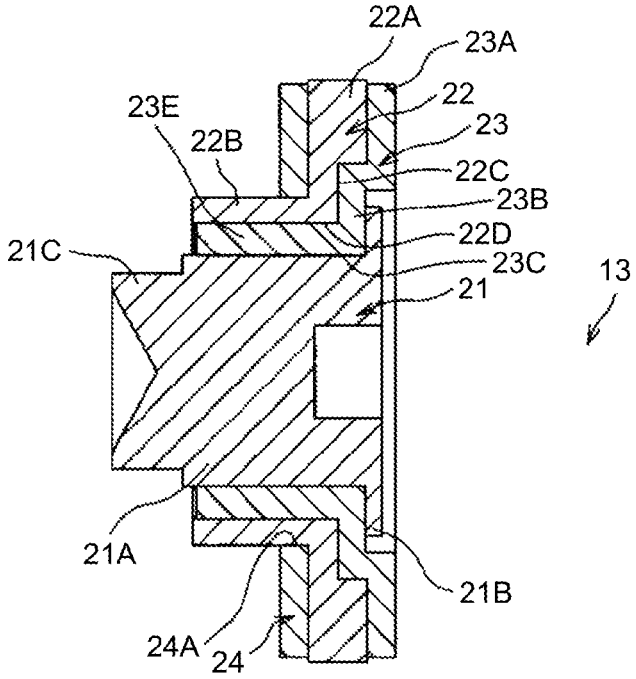
FIG. 13 is a cross-sectional view of the small-diameter roller shown in FIG. 12.

Next, a fourth embodiment of the present invention will be described with reference to FIGS. 12 and 13. The same parts as those in the above-described third embodiment are denoted by the same reference numerals, and the detailed description thereof will be omitted. The difference from the third embodiment is that the collar is formed integrally with the small-diameter sliding plate 23. A collar section 23E corresponding to the collar is provided projecting from the circumferential edge of the rotation shaft hole 23C disposed on the bottom of the seat section 23B. Similarly, the large-diameter roller 14 includes a collar section (not shown) formed integrally with the large-diameter sliding plate 26.

In the fourth embodiment, the collar section 23E is formed integrally with the small-diameter sliding plate 23, and the unillustrated collar section is formed integrally with the large-diameter sliding plate 26. Therefore, the number of components is reduced, and assembly labor can be reduced, so that assembly efficiency is improved.

Figure 14:
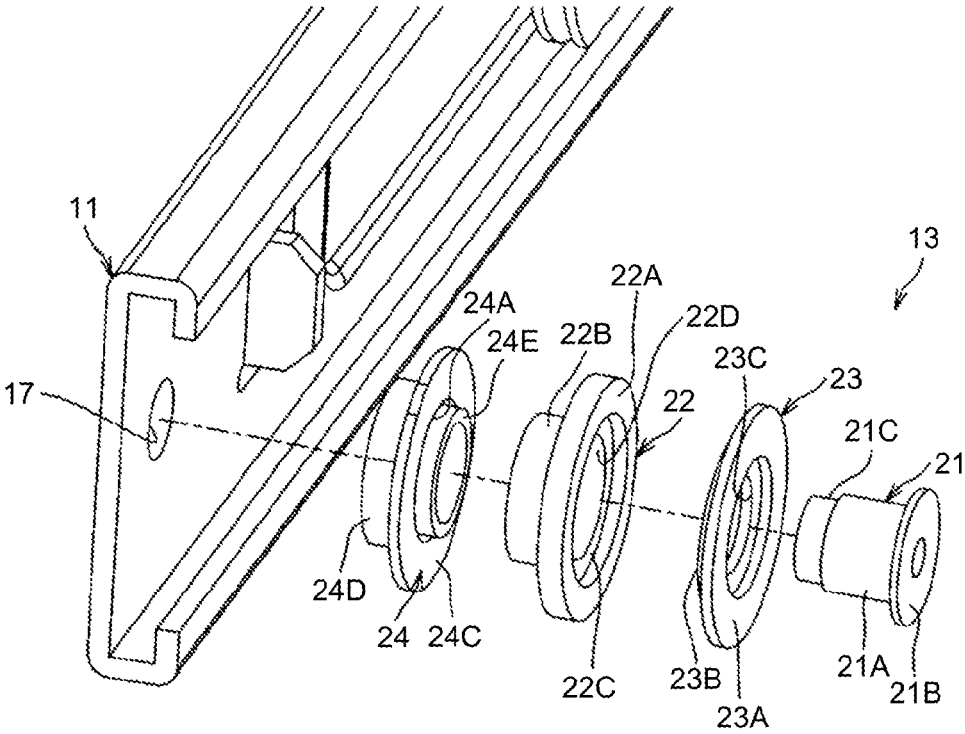
FIG. 14 is an exploded perspective view of a small-diameter roller in a fifth embodiment.
Figure 15:
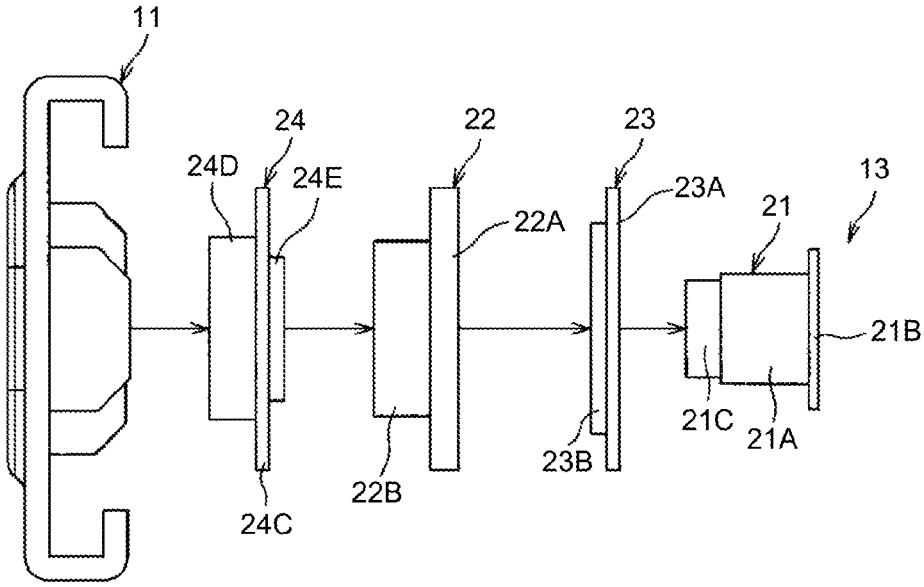
FIG. 15 is an exploded side view of the small-diameter roller shown in FIG. 14.
Figure 16:
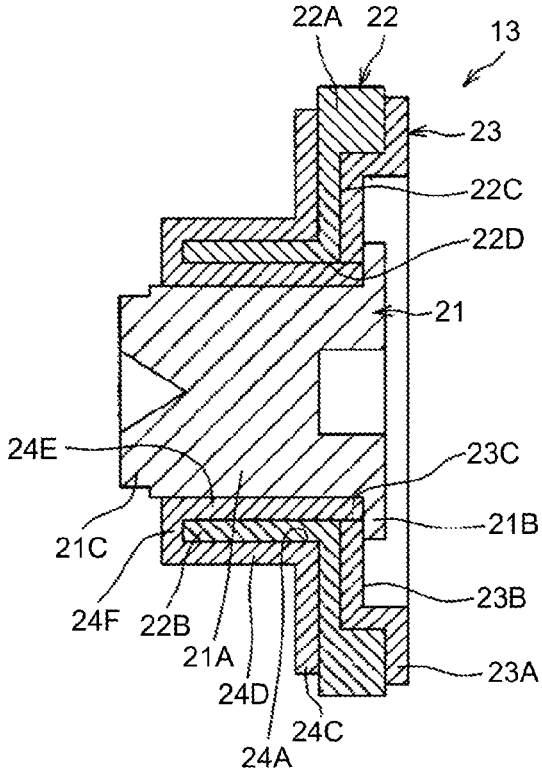
FIG. 16 is a cross-sectional view of the small-diameter roller shown in FIG. 14.

Next, a fifth embodiment of the present invention will be described with reference to FIGS. 14 to 16. The same parts as those in the above-described fourth embodiment are denoted by the same reference numerals, and the detailed description thereof will be omitted. The difference from the fourth embodiment is that the collar is formed integrally with the small-diameter sliding plate 24. To form the collar integrally, the small-diameter sliding plate 24 includes a disk section 24C, a tubular section 24D projecting from the circumferential edge of the rotation shaft hole 24A of the disk section 24C, a collar section 24E serving as the collar located in the tubular section 24D, and a connection section 24F that connects the ends of the tubular section 24D and the collar section 24E that are on the side toward the fixed rail 11. The tubular section 22B of the small-diameter roller main body 22 is inserted between the tubular section 24D and the collar section 24E. Similarly, the large-diameter roller 14 includes a collar section (not shown) formed integrally with the large-diameter sliding plate 27.

In the fifth embodiment, the collar section 24E is formed integrally with the small-diameter sliding plate 24, and the unillustrated collar section is formed integrally with the large-diameter sliding plate 27. Therefore, the number of components is reduced, and assembly labor can be reduced, so that assembly efficiency is improved.

In the first to fifth embodiments described above, the slide rails 1 are installed in the paper feeder 2, but the present invention is not limited thereto. The slide rails 1 may be installed in an apparatus from which another supported body is pulled out.

The shapes of the fixed rail 11 and the movable rail 12 are not limited to those shown in the first to fifth embodiments described above. The fixed and movable rails 11 and 12 may have any other shapes, so long as they have running walls and sliding walls.

In the first to fifth embodiments described above, the rollers are attached to both the fixed and movable rails 11 and 12, but the present invention is not limited thereto. The roller may be attached to at least one of the fixed and movable rails 11 and 12.

The present invention is not limited to the embodiments described above. More specifically, the present invention may be embodied with various modifications without departing from the scope of the present invention.

In the slide rail according to the first aspect, the roller includes the metal-made roller main body and the pair of resin-made sliding plates that sandwich the roller main body from opposite sides thereof with respect to the direction of the rotation axis of the roller, and the pair of sliding plates are in sliding contact with the sliding contact walls. Since the resin-made sliding plates are in sliding contact with the sliding contact walls, the friction between the roller and the rail is reduced, and slidability can be improved. In addition, since the metal-made roller main body is disposed between the pair of resin-made sliding plates, load resistance and durability can be ensured. Therefore, high-load resistance and high durability can be achieved simultaneously with high slidability.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A slide rail comprising:

a fixed rail;

a movable rail configured to be slidably attached to the fixed rail; and a roller configured to be attached to at least one of the fixed rail and the movable rail and runs on the other one of the fixed rail and the movable rail as the movable rail slides, the other one of the fixed rail and the movable rail including a running wall on which the roller runs and sliding contact walls that come into sliding contact with opposite side surfaces, in a direction of a rotation axis of the roller, of the roller, wherein the roller includes a metal-made roller main body and a pair of resin-made sliding plates that sandwich the roller main body from opposite sides thereof in the direction of the rotation axis of the roller, and the pair of sliding plates are in sliding contact with the sliding contact walls.

2. The slide rail according to claim 1, wherein the roller main body is secured to at least one of the pair of sliding plates.

3. The slide rail according to claim 1, wherein the roller includes;

a rotation shaft that is inserted into a rotation shaft hole of the roller to hold the roller rotatably, and a resin-made collar that is secured within the rotation shaft hole of the roller, the rotation shaft being inserted into the collar.

4. The slide rail according to claim 3, wherein the collar is formed of at least one resin selected from the group consisting of polyacetal, polyamide, polybutylene terephthalate, polypropylene, polyethylene, acrylonitrile-butadiene-styrene copolymer, polystyrene, polyphenylene ether, polycarbonate, polymethyl methacrylate, and fluorocarbon resin.

5. The slide rail according to claim 3, wherein the collar is formed integrally with one of the pair of sliding plates.

6. The slide rail according to claim 1, wherein the roller comprises a roller attached to the fixed rail and a roller attached to the movable rail, the roller attached to the movable rail is disposed at a leading end of the movable rail in a direction of accommodating the movable rail in the fixed rail, and the roller attached to the fixed rail is disposed at a leading end of the fixed rail in a direction of pulling the movable rail from the fixed rail.

7. A paper feeder comprising:

a pull-out paper feeding tray configured to accommodate paper sheets to be fed; and a pair of the slide rails configured to be attached to left and right sides of the paper feeding tray in order to guide the paper feeding tray in a pulling direction, wherein, each of the pair of the slide rails comprises;

a fixed rail, a movable rail configured to be slidably attached to the fixed rail, and a roller configured to be attached to at least one of the fixed rail and the movable rail and runs on the other one of the fixed rail and the movable rail as the movable rail slides, the other one of the fixed rail and the movable rail including a running wall on which the roller runs and sliding contact walls that come into sliding contact with opposite side surfaces, in a direction of a rotation axis of the roller, of the roller, wherein the roller includes a metal-made roller main body and a pair of resin-made sliding plates that sandwich the roller main body from opposite sides thereof in the direction of the rotation axis of the roller, and the pair of sliding plates are in sliding contact with the sliding contact walls.

8. An image forming apparatus including a slide rail, wherein the slide rail comprises;

a fixed rail, a movable rail configured to be slidably attached to the fixed rail, and a roller configured to be attached to at least one of the fixed rail and the movable rail and runs on the other one of the fixed rail and the movable rail as the movable rail slides, the other one of the fixed rail and the movable rail including a running wall on which the roller runs and sliding contact walls that come into sliding contact with opposite side surfaces, in a direction of a rotation axis of the roller, of the roller, wherein the roller includes a metal-made roller main body and a pair of resin-made sliding plates that sandwich the roller main body from opposite sides thereof in the direction of the rotation axis of the roller, and the pair of sliding plates are in sliding contact with the sliding contact walls.

* * * * *